United States Patent [19]

Chumbley

[11] Patent Number: 4,687,039

[45] Date of Patent: Aug. 18, 1987

[54] INSULATIVE PLEATED WINDOW SHADE

[76] Inventor: James F. Chumbley, 16108 Inglewood Rd., Bothell, Wash. 98011

[21] Appl. No.: 721,380

[22] Filed: Apr. 17, 1985

[51] Int. Cl.[4] ..... A47H 5/00

[52] U.S. Cl. ..... 160/84 R; 160/DIG. 7

[58] Field of Search ..... 160/84 R, DIG. 7; 428/181

[56] References Cited

U.S. PATENT DOCUMENTS

| | | | |
|---|---|---|---|
| 2,247,260 | 6/1941 | Stone | 160/84 R |
| 2,254,820 | 9/1941 | Donner | 160/84 R |
| 3,913,655 | 10/1975 | Ogino | 160/84 R |
| 4,039,019 | 8/1977 | Hopper | 160/121 R |
| 4,344,473 | 8/1982 | Shore | 160/121 R |

FOREIGN PATENT DOCUMENTS

| | | | |
|---|---|---|---|
| 756270 | 9/1956 | United Kingdom | 160/84 R |

*Primary Examiner*—J. Franklin Foss

*Attorney, Agent, or Firm*—John C. Hammar

[57] ABSTRACT

A window shade designed to compete in the roller shade and venetian blind market includes a pair of pleated sheets spaced apart in substantially parallel array by top and bottom support members. Each layer includes a vacuum deposited aluminized surface, and the shade layers are arranged so that the corresponding aluminized surfaces face one another within the shade so that the shade has a significant resistance to heat loss or gain, if properly installed, and is decorative and distinctive in appearance.

13 Claims, 3 Drawing Figures

INSULATIVE PLEATED WINDOW SHADE

TECHNICAL FIELD

The present invention relates to an insulative pleated window shade.

BACKGROUND ART

The emphasis on energy conservation in recent years has spawned the development of many insulative window shades, like the Roman shades shown and described in U.S. Pat. No. 4,397,346. Although immensely popular, most insulative shades are expensive and require specialized expertise to assemble and install. Therefore, there remains the need for a wndow shade which provides improved insulative characteristics, but which is easily retracted to essentially the same condition as a conventional roller shade or blind. Also, there is a need for an energy efficient shade which is inexpensive, durable, and lowprofile to compete in the roller shade market.

Pleated shades like the VERASOL shade are commercially available, but this type of shade does not provide any significant increase in the insulative factor for the window.

SUMMARY OF THE INVENTION

A window shade possessing the characteristics just described is made from a pair of aluminized fabric, polymeric film, or synthetic paper sheets that are adhered in substantially parallel array to a top and a bottom member. The aluminized surfaces face one another on the interior of the shade to act as reflective barriers. Because the shade is sized to fit snugly into the window casing, the energy efficiency of the window is improved. Each shade is pleated in a regular pattern, and a multiple cord draw system is used to allow the shades to be raised and lowered. When retracted, the shade stacks at the top with a very low profile. When lowered, the shade has the appearance of a pleated paper shade or closed blind. Shades of this type provide resistance to heat gain to increase comfort and to lower air conditioning load.

BEST MODE CONTENPLATED FOR CARRYING OUT THE INVENTION

Figure 3:
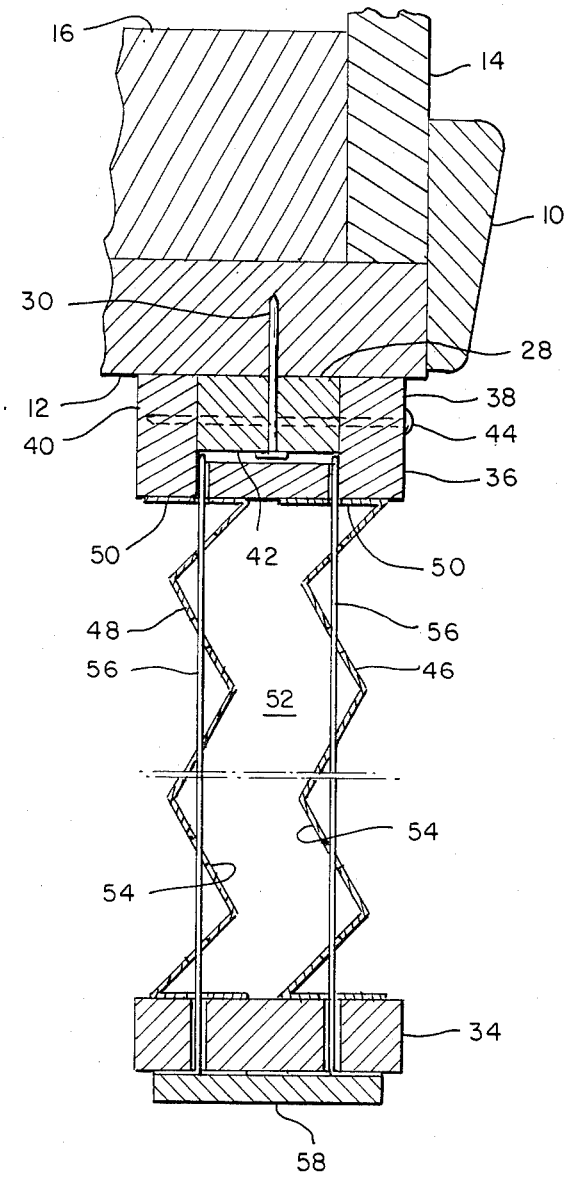
FIG. 3 is a sectional detail of a preferred window shade according to the invention, taken generally along line 3—3 of FIG. 1.

In a conventional window, best shown in FIG. 3 the top trim board 10 covers a window frame header 12 and the joint or gap to the sheetrock 14 or other wall surface. A stud or window wall header 16 underlies the sheetrock 14 over the window frame header 12. The sides and bottom of the window casing system is similar with trim boards 18, 20, and 22 covering the gap between the structural members and the window casing members 24, 25, and 26.

A wood or plastic centering guide 28 is attached 30 to the underside of the window frame header 12 to position the shade so that it will hang substantially parallel to the glass 32 and so that the wood or plastic base member 34 of the shade will rest on the window sill casing member 26, when the shade is fully extended. A wood or plastic shade mounting block 36 has legs 38 and 40 which straddle the centering guide 32 and which define a channel 42 (FIG. 3) between the bottom the centering guide 32 and the base of the "U" defined by the legs 38 and 40 of the mounting block 36. The block 36 and guide 28 can be connected by any suitable means, but a pin 44 or a plurality of spaced pins in aligned openings in the legs and guide allow quick, secure, easy, and releasible interconnection of the members.

Figure 2:
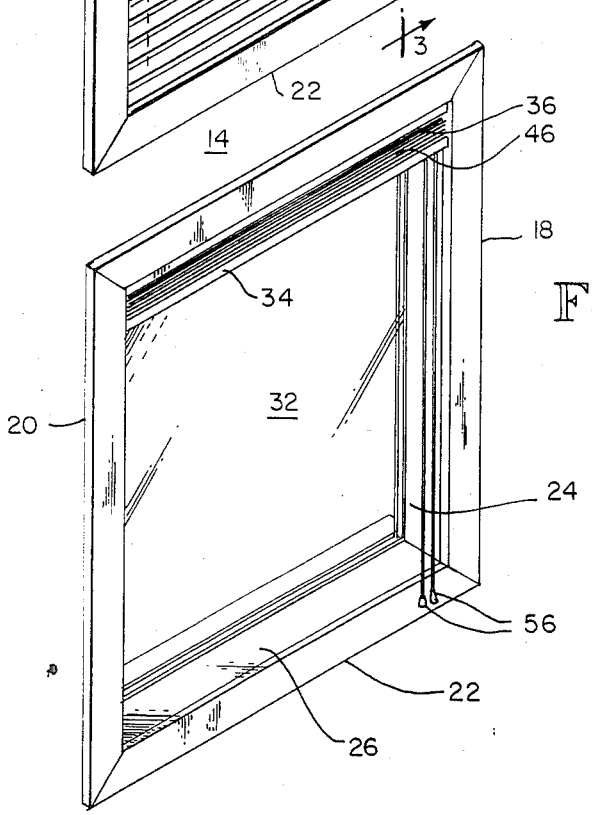
FIG. 2 is another isometric, similar to FIG. 1, showing the shade in its raised condition.

Two, pleated synthetic paper shades 46 and 48 are releasibly adhered to the underside of the mounting block 36 with double sided adhesive or some other suitable means with essentially one entire pleat 50 used to have sufficient surface area for the connection. One pleat should be used, also, to enhance the overall aesthetic appearance of the shade. The shades 46 and 48 extend downwardly in substantially parallel spaced array until each shade conects with an analogous double sided adhesive strip on the top surface of the base member 36. The shades 46 and 48 are spaced apart slightly farther than the length of a pleat so that the shades will not interweave and overlap when the shade is raised. In this way, each shade 46 or 48 is free to fold atop itself and to compress to the maximum extent, so that the raised shade has the appearance of a conventional blind and will compress to a minimum depth, as shown in FIG. 2.

The two shades 46 and 48 defne a chamber 52 between them. Each shade includes a vacuum deposited, aluminized surface 54 on the side of the shade registering with the chamber. The aluminized surface acts as a reflective layer to improve the insulative characteristics of the shade. Because the shade fits snugly between the side casing members 24 and 25 (FIG. 2) heat loss is reduced. It should be pointed out that the invention is primarily a thermally efficient, but decorative alternative to the roller shade or blind, designed to be cost competitive with this market, and is not intended to be competitive with the highly specialized market of insulative window shade as shown in U.S. Pat. No. 4,397,346. The addition of a well fitted roller shade to a single glazed window increase the "R" factor from approximatley 1.0 to about 1.5. The Roman shade of U.S. Pat. No. 4,397,346 increases the "R" factor to about 7.69. Calculations indicate that a well fitted pleated shade of the present invention will have an intermediate effect, raising the "R" factor to a midrange of about 4.2.

Figure 1:
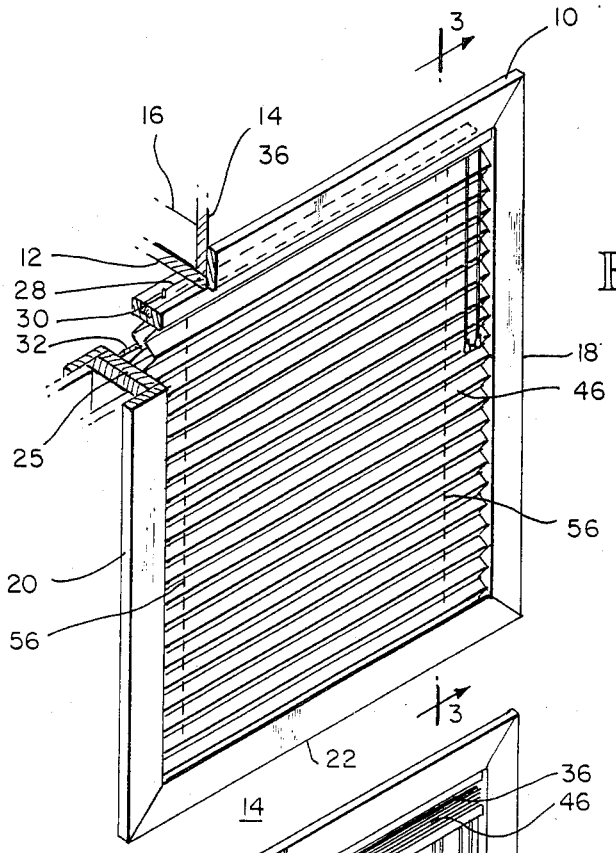
FIG. 1 is an isometric, partially in cutaway, of the window shade of the present invention.

A plurality of draw cords 56 spaced near the edges of the shade (FIG. 1) are mounted to the base mamber 34 and extend upwardly through holes in the base member 34 and in the center of each pleat of the shades 46 and 48 to corresponding vertical holes in the body portion of the mounting block 36. The holes in the mounting block 36 open into the channel 42 so that the cords 56 can run horizontally in the channel 42 to a common collection point at one end of the shade. Here, the cords 56 extend through an opening in the leg 38 of the mounting block into the room side of the shade. The cords may be drawn or retracted to raise and lower the shade much like a conventional blind. Each cord is tied to a cleat (not shown) to hold the shade in the desired position. It is possible to include a mechanical locking device or other mechanism with the cords to help position the shade in its drawn or retracted position. The system is preferred because it helps to confine the pleated shades, since each pleat includes a hole for the cord 56.

A trim board 58 to hold and conceal the draw cords 56 and the associated openings in the base member 34 should be used. This trim board can be attached with double sided adhesive to simulataneously hold the cords and the trim board.

Synthetic paper, such a KIMDURA paper, available from Kimerly-Clark Corp., is preferred for the shades 46 and 48, because of the combination of versatility, cost, durability, and appearance. This synthetic paper is water resistant, folds easily, can be coated easily with a vacuum deposited aluminum surface, comes in a variety of weights, is fine grained, and is resistant to degradation by ultraviolet light. These qualities and others make this synthetic paper particularly attractive for this application. Perhaps the most outstanding quality of synthetic paper, however, is its toughness. Its use is highly preferred.

Of course, other materials might be used for the sheets such as aluminized fabric or plastic (such as MYLAR). Real paper might be used in some applications.

The shade can be readily cut to size to be well fitted in the desired window. The top and bottom members are wood or plastic, and can be cut with ordinary home tools. The shade materials are confined between the top and bottom members, so the cuts can be made in one simple operation. Thus, the shades can be made in standard sizes, yet can easily be adapted by the homeowner to the peculiar circumstances of use.

While preferred embodiments have been shown and described, those skilled in the art will readily recognize alterations, variations, or modifications which might be made to the embodiments without departing form the inventive concept. In as much as possible, this discussion is meant to illustrate the invention and not to limit it. The claims should be interpreted liberally to cover the preferred embodiments and all their equivalents, and should not be limited, unless such limitation is necessary in view of the pertinent prior art.

I claim:

1. A window shade and hanging system, comprising:

(a) a centering guide affixed to the bottom of the window frame head and extending substantially from one side of the window to the other;

(b) a shade mounting block connectible with the centering guide across essentially the entire width of the window;

(c) a first pleated shade fabric which is connected to the block and which extends substantially over the entire area of the window when drawn, the fabric including a vacuum deposited, aluminized reflective layer on one side;

(d) a second pleated shade fabric having pleats of substantially the same size as the first fabric, the second fabric being connected to the block in parallel alignment with the first fabric to define a chamber between the fabrics, the fabrics being spaced apart a distance slightly greater than the length of one pleat to ensure that the fabrics do not interweave and overlap when the shade is raised, the second fabric also including one vacuum deposited, aluminized reflective layer on one side, the aluminized layers facing the chamber on each fabric;

(e) a base member connected to both fabrics at the bottom of each fabric; and (f) means for raising and lowering the shade by lowering or raising the base with respect to the block.

2. The system of claim 1 wherein the base includes two spaced strips of double sided adhesive on the top of the base for interconnecting the base with the fabrics.

3. The system of claim 1 wherein each shade fabric is made from synthetic paper.

4. The system of claim 1 wherein the means for raising and lowering the shade includes a plurality of pairs of draw cords connecting the base and the block and extending through a plurality of openings in each shade fabric, there being one opening for each pleat.

5. The system of claim 4 wherein the block includes a U-shaped channel member having legs which straddle the guide, the legs of the channel being slightly longer the the height of the guide to create a channel between the guide and block where the draw cords can extend along the length of the block.

6. The system of claim 5 wherein the guide and block are interconnected by a plurality of pins which seat in registered openings that extend through the legs and the guide.

7. The system of claim 6 wherein the guide, block, and base are wood to allow ease of cutting to the necessary length.

8. The system of claim 1 wherein the shade fabrics are attached to the block with two pieces of double sided adhesive mounted in parallel alignment on the block.

9. The system of claim 4 wherein each draw cord extends substantially through the center of each pleat, and wherein the first and last pleat are attached to the block and base respectively, substantially along the entire length and width of the pleat.

10. The system of claim 1 wherein the shade fabrics are substantially the same width as the window.

11. The window shade of claim 1 wherein the first pleated shade fabric and the second pleated shade fabric are made from the same material and are disconnected entirely from one another, each shade fabric having a plurality of horizontal pleats extending transversely across each shade fabric.

12. The window shade of claim 11 the material of each shade fabric is a fine grained, water resistant, and UV resistant synthetic paper.

13. A window shade system, comprising:

(a) a wood centering guide tacked to the underside of a window head and extending substantially between the sides of the window to form a top air circulation barrier;

(b) a wood channel straddling the centering guide and connected to the guide with suitable fasteners, the channel including legs that are at least slightly longer than the height of the guide so that the channel and guide define a chamber, the channel extending substantially across the entire width of the window;

(c) two aligned strips of double sided adhesive mounted on the bottom of the channel;

(d) one pleated shade fabric adhered to each adhesive strip so that the fabrics do not interweave or overlap when the shade is raised, each fabric being a synthetic paper sheet having an aluminized surface on one face, the surfaces registering against one another, each sheet having a width substantially equal to the width of the window and a length at least slightly longer than the height of the window, the two fabrics defining a gap between them;

(e) another two aligned strips of double sided adhesive connected to the fabrics, one adhesive on the last pleat of each fabric;

(f) a plurality of openings in each fabric, each opening being substantially at the center of each pleat, each fabric having at least two longitudinal series of openings;

(g) a plurality of draw cords threaded through the openings and extending through holes in the channel into the chamber defined by the channel and guide, along the channel in the chamber to a collection point, and out through the front of the channel through a common bore;

(h) a wood base adhered to the adhesive on the last pleat of each fabric so that the fabrics are separated far enough apart that the fabrics do not interweave or overlap when the shade is raised, the base including a plurality of openings for receiving the draw cords; and (i) means for interconnecting the draw cords to the base so that the base raises or lowers with respect to the the channel in response to raising or lowering the cords.

* * * * *